United States Patent [19]

Dallaire

[11] Patent Number: 4,625,973

[45] Date of Patent: Dec. 2, 1986

[54] TRAINING MOVING TARGET SYSTEM

[75] Inventor: Jean-Guy Dallaire, Loretteville, Canada

[73] Assignee: Minister of National Defence of her Majesty's Canadian Government, Ottawa, Canada

[21] Appl. No.: 748,214

[22] Filed: Jun. 24, 1985

[30] Foreign Application Priority Data

Aug. 21, 1984 [CA] Canada ..... 461481

[51] Int. Cl.[4] ..... F41J 9/02

[52] U.S. Cl. ..... 273/366

[58] Field of Search ..... 273/357, 360, 366, 367, 273/368, 369, 370; 446/431–434, 444–447, 454–456

[56] References Cited

U.S. PATENT DOCUMENTS

| | | | |
|---|---|---|---|
| 3,039,229 | 6/1962 | Van Cleemput | 446/434 |
| 3,147,817 | 9/1964 | De Liban | 446/455 X |
| 3,675,366 | 7/1972 | Tomiyama | 446/434 |
| 4,226,292 | 10/1980 | Monte et al. | 273/359 X |

OTHER PUBLICATIONS

Playthings 6–1958, p. 67, #57 Farm Set.

Popular Science Monthly 5–1937, p. 52, Dummy Ships on Wheels.

*Primary Examiner*—Paul E. Shapiro

*Attorney, Agent, or Firm*—Cushman, Darby & Cushman

[57] ABSTRACT

A mobile target system with a driverless, self-propelled tractor vehicle on relatively low profile and a low profile, wide track trailer with a long drawbar articulately connected to the tractor. Projectile targets are carried by the trailer. The control for the tractor controls the vehicle to drive along a selected path. This may include a ground wire that the tractor follows and a radio control unit for initiating an excursion of the target along the path. The separation of the traction and the target stability functions allows the use of a relatively small, easily steered tractor vehicle, while the target carrying trailer may be a relatively easily steered single axle trailer with a high stability wide track. Separation of the target from the tractor provides some modest protection for the tractor.

6 Claims, 3 Drawing Figures

TRAINING MOVING TARGET SYSTEM

FIELD OF THE INVENTION

The present invention relates to a moving target system primarily intended for anti-armour weapons training.

BACKGROUND

The moving target systems that are commercially available suffer from certain disadvantages. Some systems use permanently installed rails for guidance of the target carrier and are thus inflexible and tend to be rather expensive. More flexible systems using self-propelled ground supported vehicles as target carriers expose the vehicles to damage by direct hits and may suffer from stability problems in high to moderate winds unless the targets are designed to be wind transparent.

SUMMARY

The aim of the present invention is to provide an improved moving target system.

According to the present invention there is provided a mobile target system comprising:

(a) a driverless, self-propelled tractor vehicle;

(b) a trailer vehicle including a drawbar articulately connected at a distal end thereof to the tractor vehicle so as to be towed thereby;

(c) means for mounting a projectile target on the trailer vehicle; and (d) control means for controlling the tractor vehicle to drive along a selected path.

With this system, the two functions of traction and stabilization are separated by providing the tractor for movement and the target carrying trailer that may have a very wide track for good wind stabilization. The separation between the tractor and trailer provides some projectile or fragment protection in the case of a hit.

The system may be embodied in various ways. Particularly susceptible to modification is the control means, which may be a radio operated remote control system or a self-guiding control using a ground wire to define the target path.

BRIEF DESCRIPTION OF THE DRAWINGS

In the accompanying drawings, which illustrate exemplary embodiments of the present invention.

DETAILED DESCRIPTION

Figure 1:
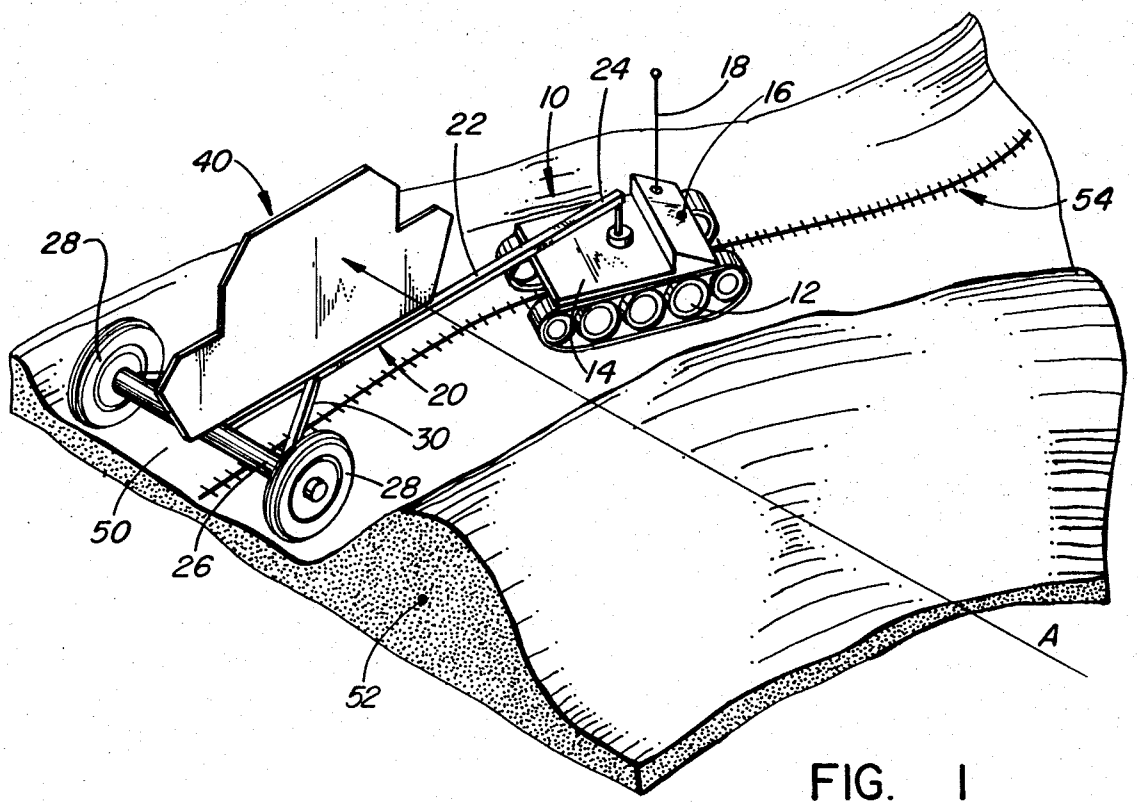
FIG. 1 is a perspective view, partially in section, of a mobile target system according to the present invention.

Referring to the accompanying drawings, and particularly to FIG. 1, there is illustrated a mobile target system according to the present invention. The system includes a driverless, self-propelled tractor vehicle 10. The illustrated vehicle is propelled by ground engaging tracks 12, driven by a motor that is not illustrated in the drawing. The tractor is low in profile with a flat bed 14 and a small housing 16 at the front to contain the electronic self-guiding system. The tractor 10 is designed to function in response to radio transmitted signals and thus the housing 16 contains a radio receiver with an antenna 18.

A trailer vehicle 20 trails the tractor 10. The trailer includes a long drawbar 22 articulately connected at its distal end 24 to the bed of the tractor 10. The connection is such as to permit universal articulation of the drawbar on the tractor 10. At the rear end of the trailer vehicle 20 is an axle 26 carrying ground support wheels 28 at its opposite ends. The trailer also includes two braces 30 (one is shown) joining the drawbar 22 to the axle 26 to keep the axle normal to the drawbar.

The trailer 20 carries a panel target 40 shaped to resemble the silhouette of a target vehicle, in this case a tank. The panel is affixed to the drawbar 22 and is thus parallel to the direction of movement of the trailer 20.

The tractor 10 and trailer 20 are shown running on a levelled path 50. The spoil earth from the ground levelling operation is heaped on that side of the path towards the firing position to provide a protective berm 52 both protecting and concealing the tractor 10 and trailer 20. The direction of fire is illustrated by the arrow A in FIG. 1.

Tractor 10 is guided along the path 50 by a guide wire 54 and a guide wire sensor on the tractor 10. Systems of this sort are known and have been incorporated in earlier mobile target systems, for example the Marconi Space and Defence Systems Ltd., RECAT (Remotely Controlled Agile Target) System. Consequently, this guidance arrangement will not be described in further detail.

Figure 2:
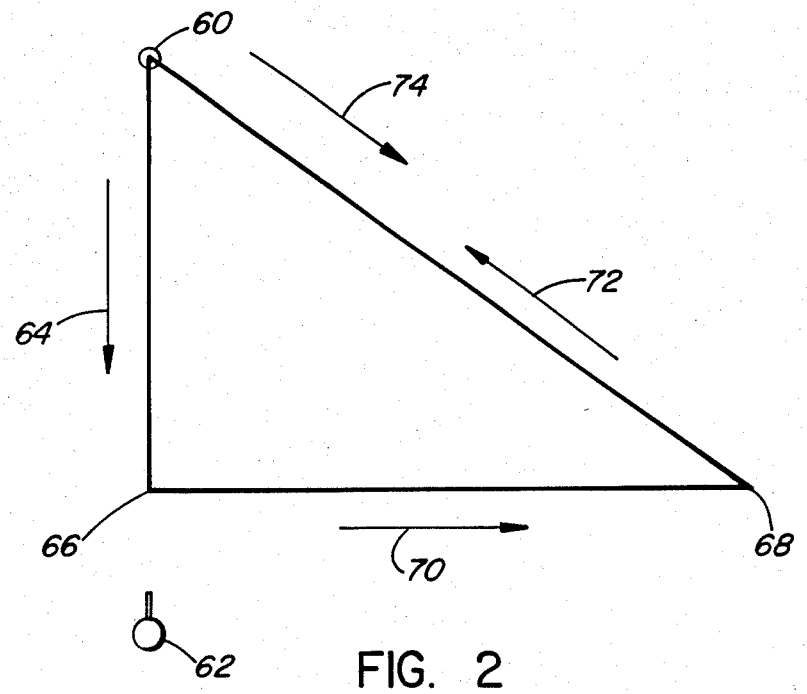
FIG. 2 is a schematic plan view showing typical moving target running paths.

Referring to FIG. 2, this drawing illustrates typical moving target running paths. The starting point for the target is at 60 and the fire position is illustrated at 62. Target travel from point 60 in the direction of arrow 64 directly towards the firing point 62 represents a frontal engagement of the target. Movement of the target along that portion of the path between point 66 and 68, in the direction of arrow 70 represents a broadside engagement of the target. Return of the target to the starting point 60 is in the direction of arrow 72. Movement of the target from the starting point 60 towards the point 68, in the direction of the arrow 74 represents oblique engagement of the target.

The target illustrated in FIG. 1 is designed particularly for broadside and oblique engagement. For frontal engagement a different sort of target representing the frontal silhouette of the target is required. Various target configurations are known for this purpose and may be used in conjunction with the illustrated system.

Figure 3:
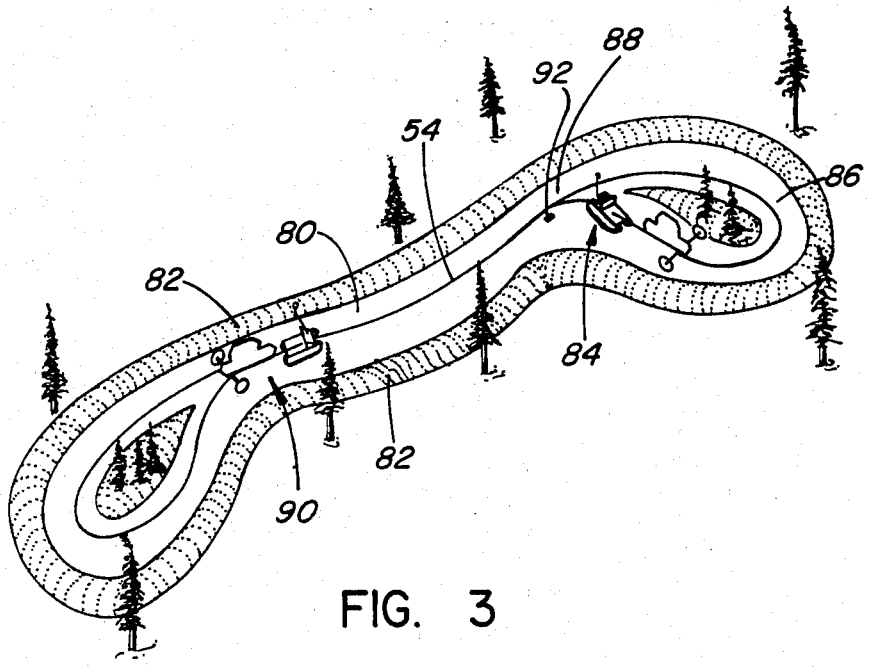
FIG. 3 is a pictorial representation of a typical moving target excursion scenario.

FIG. 3 of the accompanying drawings illustrates a typical moving target excursion scenario. This includes a levelled path 80 with berms 82 of spoil earth on opposite sides of the path. At position 84, the moving target is shown returning around a loop 86 at one end of the path to a starting position at 88. At the other end of the path 80, the target is shown at a position 90 that is the end of the excursion. As in the embodiment of FIG. 1, the tractor vehicle is guided by the wire 54 extending along the path 80. The system illustrated in FIG. 3 also includes triggers 92 (one shown) at the start and end positions 88 and 90. The tractor vehicle 10 carries a sensor for detecting the presence of a trigger 92. When a trigger is sensed, the vehicle stops until signalled by radio to start another excursion. The same arrangement can be used to provide for a more general speed change along the path.

The present system is completely automatic and requires no personnel attendance during operation. Additional safety features may be added, for example automatic stoppage of the tractor if it loses the guide wire or if the radio system is damaged.

The embodiments of the invention in which an exclusive property or privilege is claimed are defined as follows:

1. A mobile target system comprising:

(a) a driverless, self-propelled tractor vehicle;

(b) a trailer vehicle including a long drawbar, means connecting a distal end thereof to the tractor vehicle for universal articulation thereon and widely spaced ground support wheels mounted on opposite sides of the drawbar, remote from the tractor vehicle;

(c) a projectile target comprising a panel shaped to simulate the silhouette of an armoured military vehicle;

(d) means mounting the projectile target on the trailer vehicle; and (e) control means for controlling the tractor vehicle to drive along a selected path.

2. A system according to claim 1 wherein the trailer comprises a single axle carrying the ground support wheels at either end thereof and wherein the drawbar extends forwardly from the axle.

3. A system according to claim 1 wherein the control means include a guiding means extending along the path and means on the tractor vehicle for causing the vehicle to follow the guiding means.

4. A system according to claim 3, wherein the guiding means is a wire.

5. A system according to claim 1, wherein the control means include radio control means on the vehicle to be controlled by a transmitter from a remote location.

6. A system according to claim 1, wherein the control means includes at least one trigger element along the path, sensor means on the tractor vehicle for detecting the trigger element and means responsive to detection of the trigger element to alter the propulsion speed of the vehicle.

* * * * *